US007526887B2

(12) United States Patent
Engel

(10) Patent No.: US 7,526,887 B2
(45) Date of Patent: May 5, 2009

(54) PUMP GUN

(76) Inventor: Heinz-Eckhard Engel, Leipzinger Strasse 2, 35088 Battenberg (DE)

( * ) Notice: Subject to any disclaimer, the term of this patent is extended or adjusted under 35 U.S.C. 154(b) by 108 days.

(21) Appl. No.: 11/790,042

(22) Filed: Apr. 23, 2007

(65) Prior Publication Data

US 2008/0168694 A1 Jul. 17, 2008

(30) Foreign Application Priority Data

Apr. 23, 2006 (DE) ..... 20 2006 006 616 U

(51) Int. Cl.
*F41C 7/00* (2006.01)

(52) U.S. Cl. ..... 42/16; 42/10; 42/43

(58) Field of Classification Search ..... 42/16, 42/10, 43

See application file for complete search history.

(56) References Cited

U.S. PATENT DOCUMENTS

| | | | | | |
|---|---|---|---|---|---|
| 44,545 | A * | 10/1864 | Mellen | ..... | 42/16 |
| 2,155,512 | A * | 4/1939 | Swebilius | ..... | 42/16 |
| 2,324,775 | A * | 7/1943 | Hentschel | ..... | 42/2 |
| 2,368,708 | A * | 2/1945 | Goff | ..... | 42/16 |
| 2,479,393 | A * | 8/1949 | Minasola | ..... | 42/16 |
| 2,552,214 | A * | 5/1951 | Raymond | ..... | 42/16 |
| 2,861,374 | A * | 11/1958 | Hampton | ..... | 42/16 |
| 7,269,918 | B2 * | 9/2007 | Merlino | ..... | 42/17 |

FOREIGN PATENT DOCUMENTS

| | | |
|---|---|---|
| CH | 751 | 4/1889 |
| EP | 692 696 | 7/1999 |

* cited by examiner

*Primary Examiner*—Michael Carone
*Assistant Examiner*—Samir Abdosh
(74) *Attorney, Agent, or Firm*—Clark & Brody

(57) ABSTRACT

A pump gun (10) comprises a barrel (11), a main stock part (12), a fore stock (12) supported in longitudinally displaceable manner and is linked to a breech lock (17) which, in the closed position of the pump gun (10), can be made to engage the rearward barrel end (21). The breech lock (17) and the fore stock (12) are linked to each other in a manner that upon displacing the fore stock (12), the breech lock (17) can be driven in the opposite direction to that of the fore stock (12). As a result, the pump gun (10) may be safely operated without recourse to a stop and, in the ready to fire initial state, is devoid also of any pumping excursion gap. The invention moreover offers a weapon matching marksman ergonomics and esthetics in its closed or ready to shoot state.

16 Claims, 8 Drawing Sheets

PUMP GUN

The present invention relates to a pump gun defined in the preamble of claim 1.

Contrary to the case of automatic or semi-automatic weapons, the pumping displacement in pump guns is manual. In order to carry out such motions rapidly, techniques are employed making gun-gripping superfluous except for the chamber grip. As regards pump guns fitted with a cartridge magazine, breech lock opening, ejecting a fired cartridge, feeding a cartridge for the next firing into the weapon barrel and cocking the lock is carried out solely by moving the gun's fore stock by the marksman's guiding hand.

As regards the pump guns of the state of the art, the fore stock of the firing-ready weapon always is situated in the front end position, that is the end position away from the marksman. In this position the breech lock is always closed. Opening the breech lock, ejecting the empty cartridge and cocking the lock are implemented by manually moving the fore stock from the front end position into the rear end position facing the marksman. On account of the ensuing displacement of the fore stock into the front end position, the cartridge slated for the next shot is fed from the magazine to the pump gun barrel and the breech lock then is closed. In that state the pump gun is ready to fire.

However when firing a shot and for each gun leveling, the fore stock—situated in the front end position and resting in the aiming hand—will be inevitably pulled toward the marksman. In the process the breech lock may be accidentally opened. To preclude this eventuality, known pump guns are fitted with a stop for the fore stock in its front end position to suppress accidentally retracting the fore stock. Such a stop is mandatory to the safe handling of the pump gun.

Therefore the design of known pump guns incurs a substantial, intrinsic drawback. Closing the breech lock forces the marksman to move the front stock in the direction of firing. On the other hand firing ipso facto requires pulling the fore stock toward the marksman. The stop precludes accidental weapon opening in this process. Such a sequence of motions is laborious, time-consuming and goes against the marksman's natural inclinations.

The fore stock of the ready to fire pump gun being in its front end position. most of known pump guns when in their initial positions exhibit a pumping excursion gap the size of the repeating excursion between the housing and the fore stock. As a result a portion of the guidance system and the pump gun rods is unprotected. Known pump guns therefore are significantly susceptible to malfunctions illustratively due to soiling. The marksman must consistently take care to preclude soiling penetration. This feature in particular degrades optimally convenient pump gun handling.

The European patent document EP 0 692 696 B1 offers palliation in the form of a pump gun free of a pumping excursion gap in the initial, ready to fire state. The fore stock of the pump gun disclosed in said document is pivotably supported about a fixed pivot point. When being moved toward the marksman, the fore stock is pivoted by means of an appropriate guide underneath the chamber. As a result, the pumping excursion gap usually present in the ready to shoot initial state is eliminated. Instead the fore stock seals the chamber by its rear end because, at the end of the procedure, the pumping excursion—contrary to the case for typical fore stock repeats—was moved underneath the frame. However, the fore stock being in the front end position in the pump gun initial state, this known design also requires a stop for safe handling. Moreover the translational and pivoting kinematics requires a comparatively bulky fore stock precluding the simplicity of linear guidance.

The object of the present invention is to create a pump gun which can be safely handled without requiring a stop and which is devoid of a pumping excursion gap in the ready to shoot initial condition. In addition the goal of the present invention is a weapon which offers both marksman ergonomics and an esthetic appearance in its closed or ready to fire state.

The main features of the present invention are defined in claim 1. The claims 2 through 16 contain embodiment modes of the present invention.

Regarding a pump gun fitted with a barrel, a main stock part, a longitudinally displaceable fore stock and a breech lock linked to latter, said breech lock engaging the rear barrel end of the pump gun in latter's closed position, the present invention provides that the breech lock and the fore stock be linked in a manner that when the fore stock is being displaced, the breech lock can be driven oppositely the direction in which the fore stock is being displaced.

The breech lock actuation in the direction opposite the fore stock's direction of displacement entails a complete reversal of the functions associated with the two directions of displacement of the fore stock. In the gun pump of the present invention, wherein the fore stock is displaced from the front end position away from the marksman into the rear end position facing this marksman, a cartridge is fed into pump gun barrel and the breech lock is closed.

Otherwise than in the state of the art, in the present invention, accordingly, it is the rear end position of the fore stock which defines the ready-to-shoot initial state of the pump gun, wherein the fore stock's rear end rests against the chamber. The present invention thus precludes inadvertent fore stock displacement by the guiding hand, an additional advantage moreover being attained in that there is no need for the stop required in heretofore known pump guns.

The fore stock in the ready-to-shoot initial state being in the rear end position, the pump gun of the present invention when in this ready to shoot initial state now is devoid of a pumping excursion gap, that is a gap the size of a repeat excursion. Contrary to the case for known pump guns, the pump gun of the present invention instead will be fully closed. Accordingly soiling the inside of the weapon is completely averted. Again, contrary to the case for the conventional pump guns, handling also is convenient. The marksman also may expose the ready to shoot weapon to a soiling ambience, never to worry that dirt might enter said weapon.

In one embodiment mode of the pump gun of the present invention, the breech lock and the fore stock are linked by a motion reversing transmission to implement the discussed reversal motion, said system in one concrete design consisting of a push bar connected to the fore stock, further of an actuation bar connected to the breech lock and of at least one rotatably configured gear engaging commensurately designed portions of push bar and actuation bar.

In the process, the actuation bar connected to the breech lock actuates the breech lock head. Using the gear engaging the corresponding portions of the fore stock push bar and of the actuation bar, the motion of the push bar connected to the fore stock is converted into a motion opposite that of the actuation bar.

Preferably the portions of the actuation bar and of the push bar are designed to be toothed or slotted to engage the gear. Alternatively and as shown in another embodiment mode, they are fitted with preferably continuous ladder-type recesses, said alternative embodiment advantageously being manufactured using a ladder-type stamped mesh.

Advantageously for manufacture, the gear shall be supported on a shaft affixed to the chamber.

In a further advantageous embodiment mode of the pump gun of the present invention, the gear is mounted in rotatable manner on a guide which is configured along the barrel and is fitted with a slide. The fore stock and the push bar are affixed to said slide, so that a manual displacement of the fore stock shall be directly converted into a slide displacement on the guide configured along the barrel and lastly into a push bar displacement. Said displacement in turn is converted by means of the gear into an oppositely directly displacement of the breech lock actuation bar. By guiding the slide on the guide configured along the barrel, the present invention attains smooth and hence ergonomically advantageous fore stock handling.

In an alternative embodiment mode of the pump gun of the present invention, the reversal of motion is implemented by using the breech lock and by the fore stock being linked by looping drives, belt drives, belt transmissions or the like, which in practical implementations may be cable/rope drives, chain drives, belt drives or toothed belt drives, the chain drive looping a set of two sprockets and a chain looping the set of two sprockets, the belt drive comprising two disks and a belt looping set of two disks and the toothed belt drive comprising two geared disks and a toothed belt looping the set of toothed disks.

In one practical embodiment implementing the motion reversal of the present invention using a looping drive, the rollers, the sprockets, the disks or the toothed disks of the looping drive are rotatably configured at a guide running along the barrel, a slide being displaceably mounted on said guide and being affixed to the fore stock, the slide being linked to one of the two segments of the looping drive and an actuation bar connected to the breech lock being linked to the other of the two segments. The expression "segment" herein foremost denotes the free portions of the enveloping drive, namely the free segments of the rope/cable, chain, belt or toothed belt that constituting the "loop" of the looping drive.

In the above reduced-to-practice embodiment, a manual fore stock displacement is directly converted into a displacement of the slide running in the guide along the barrel, and this latter displacement in turn on account of the extant connection between the slide and one of the two segments of the looping drive is converted into a rotation of the rollers, of the sprockets, of the disks or toothed disks of the looping drive, in turn and finally resulting in an oppositely directed displacement of the breech lock actuation bar connected to the other segment of said looping drive.

The present invention also provides that the looping drive, the belt drive, the belt transmission or the like shall be a speed step-up/step-down transmission. In this manner the fore stock and the breech lock head may be optionally displaced along different lengths.

Further features, details and advantages of the present invention are stated in the claims as well as discussed in the description below of illustrative embodiment modes and drawings.

Figure 2:
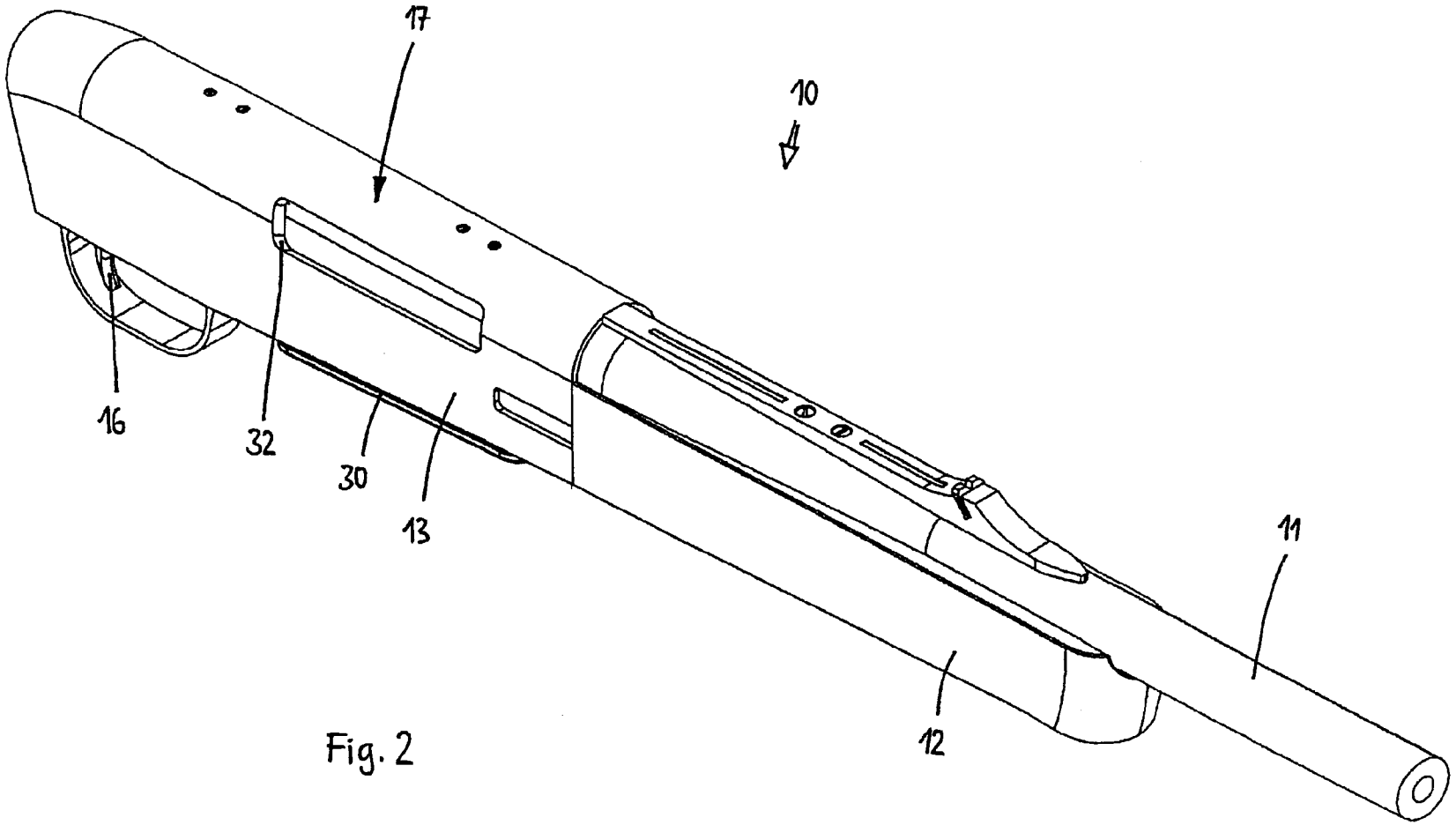
FIG. 2 is a perspective of another embodiment mode of a pump gun.
Figure 4:
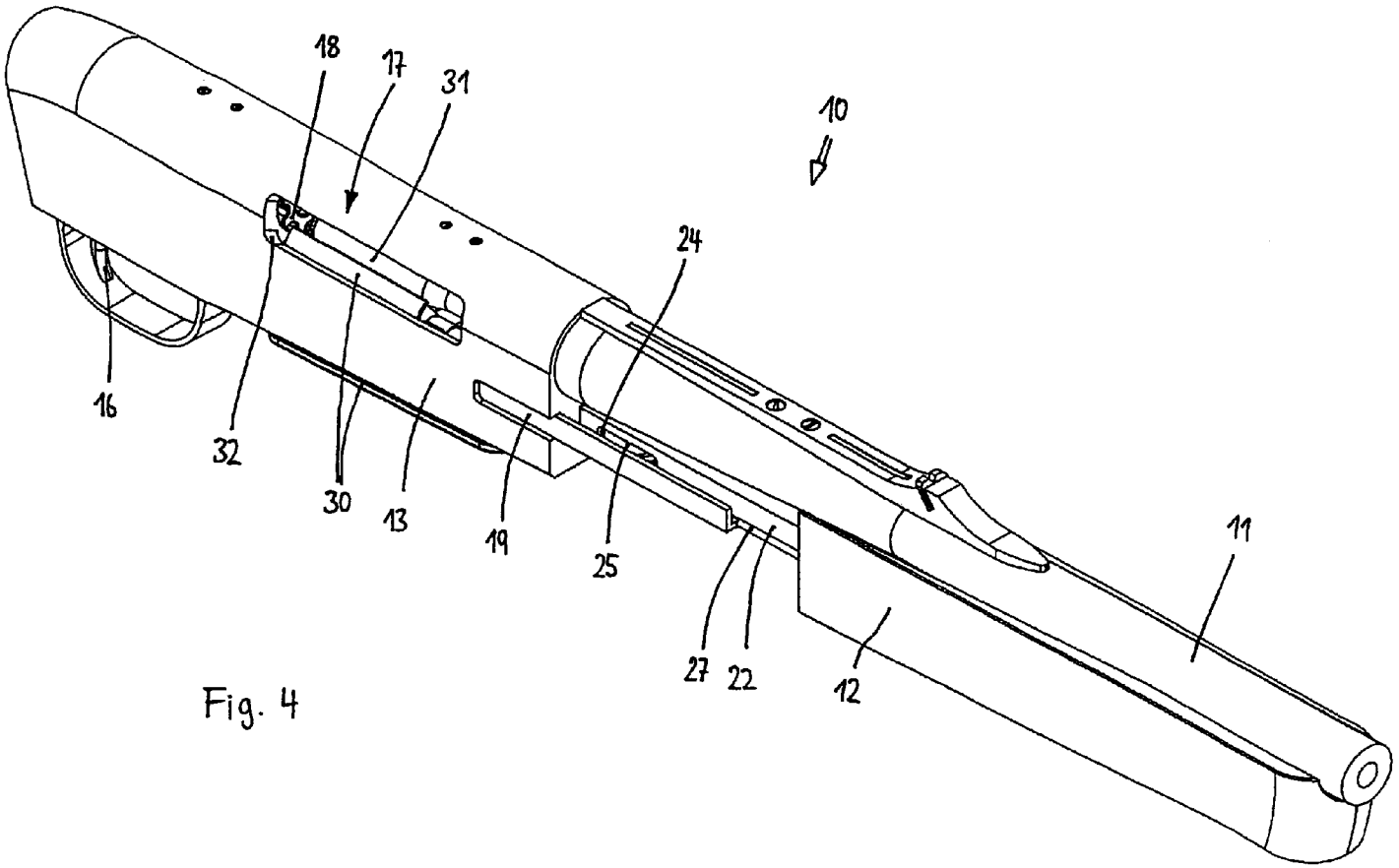
Figure 5:
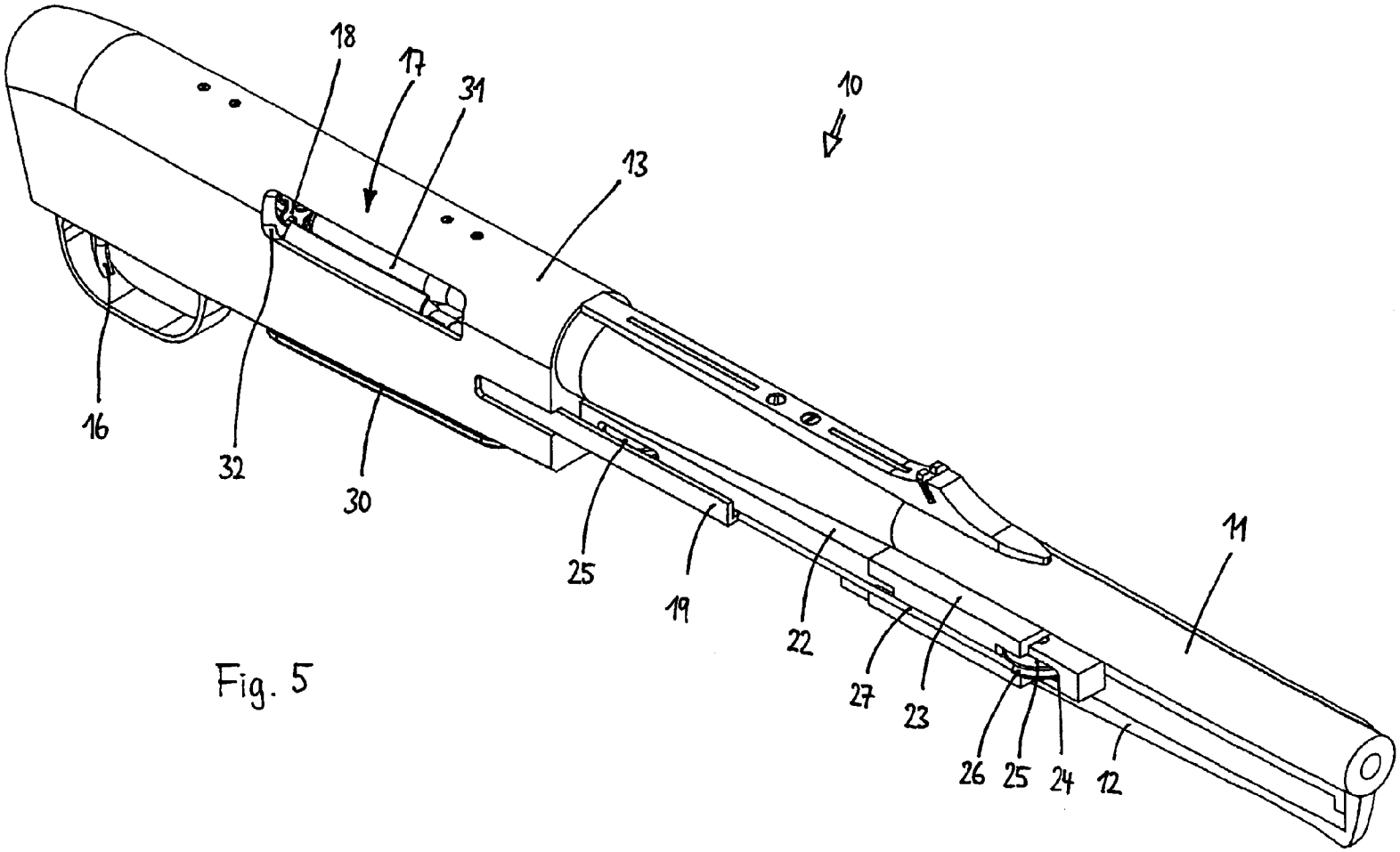
Figure 6:
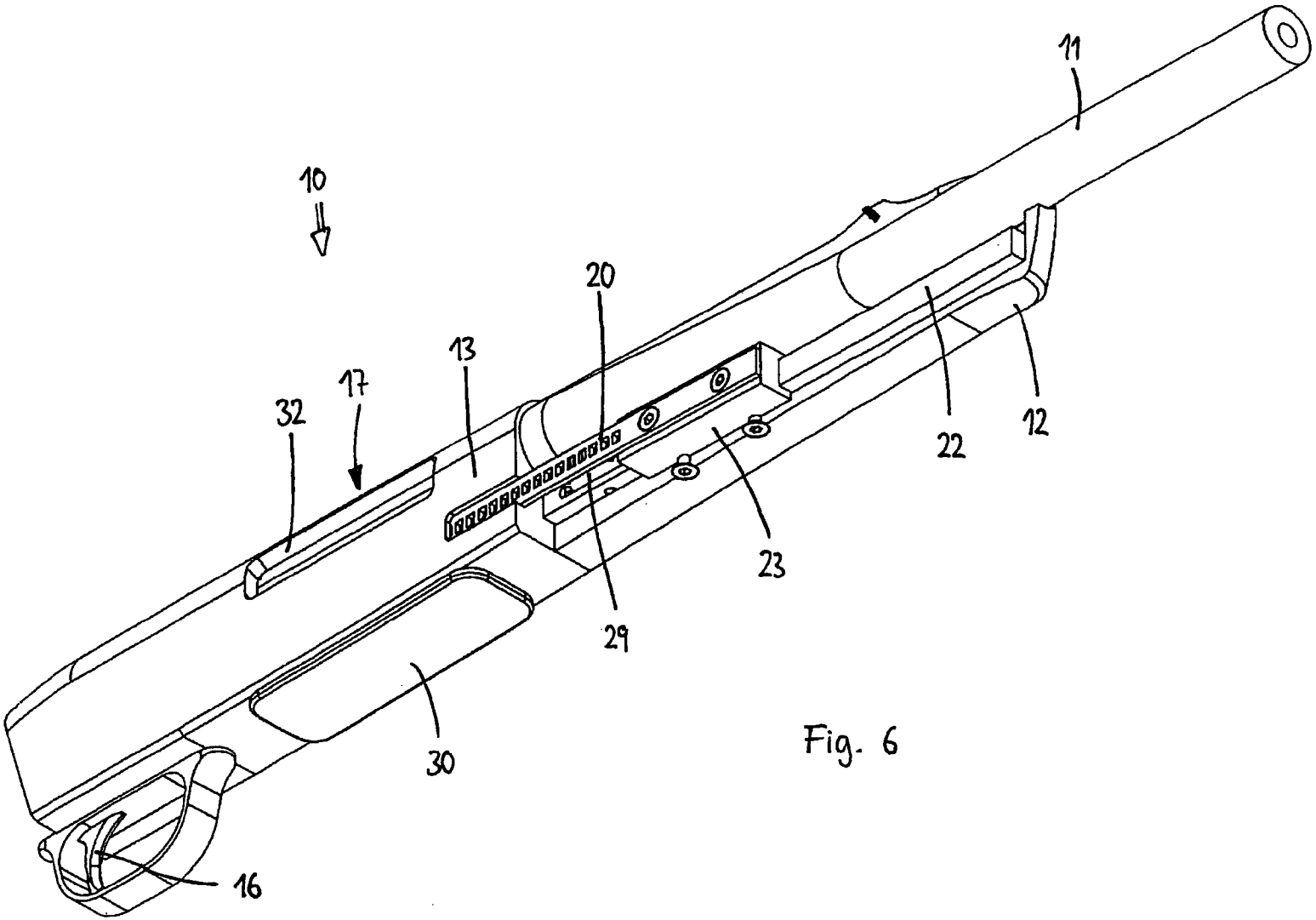
Figure 7:
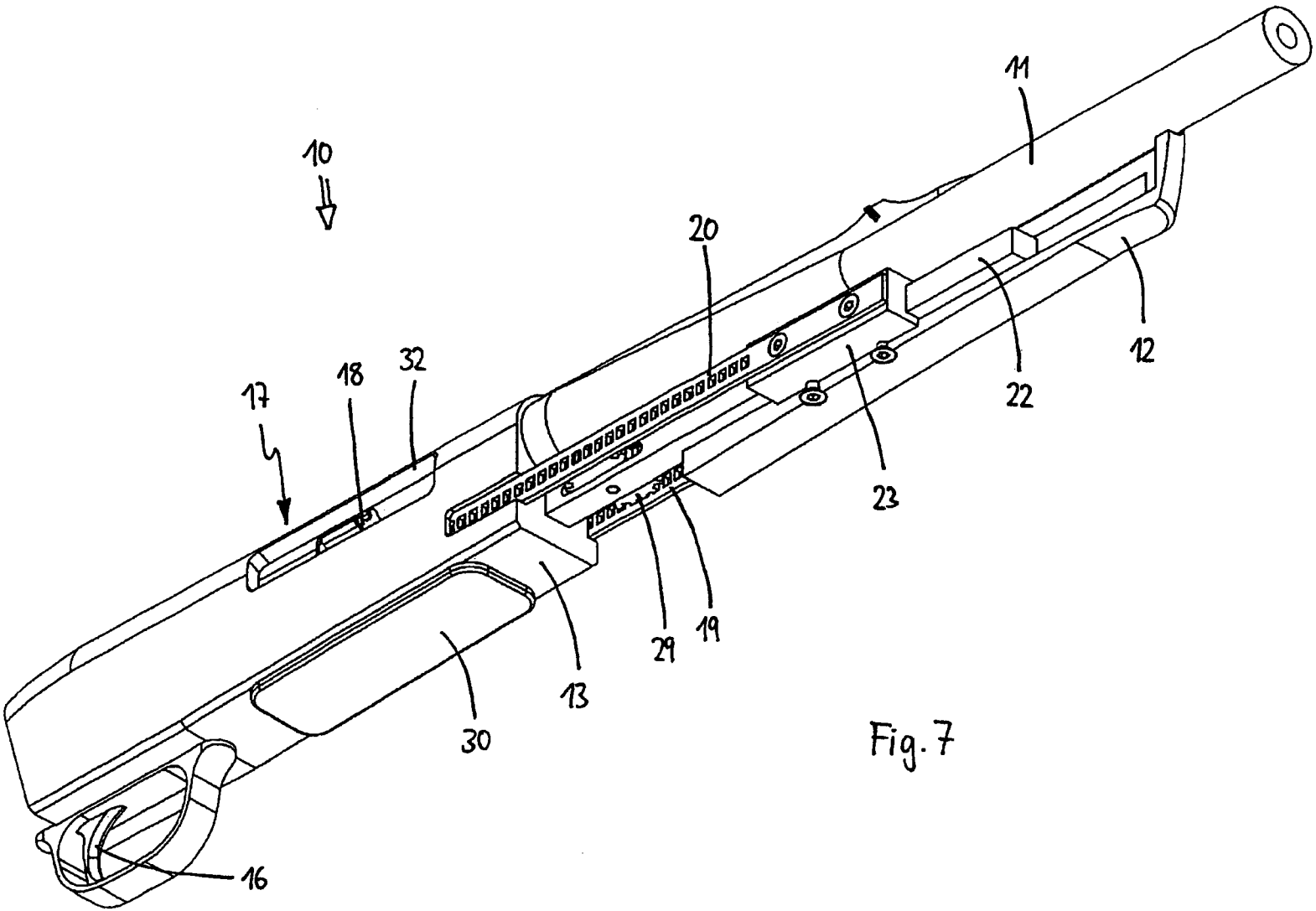
Figure 8:
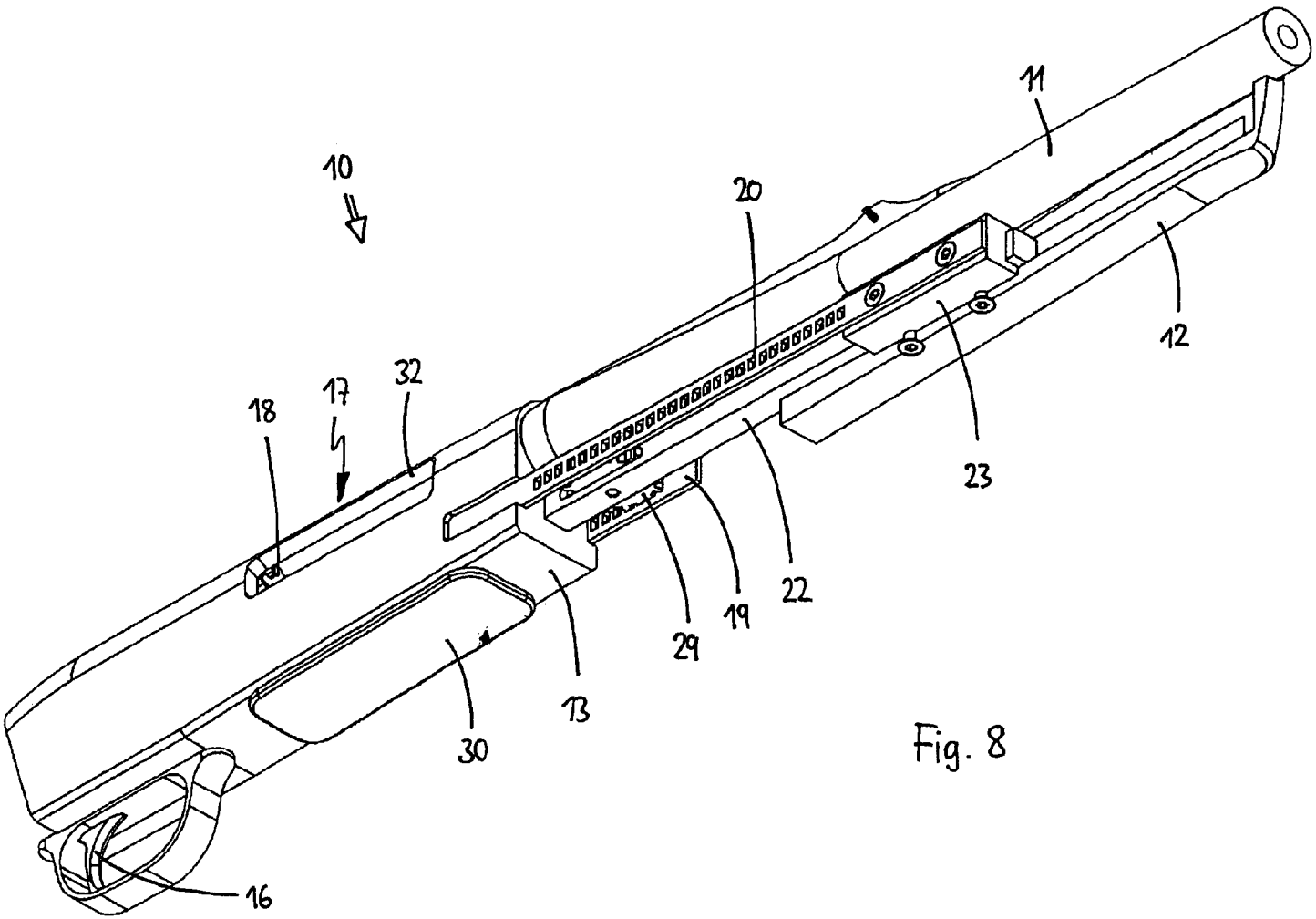

FIG. 4 is a perspective view of the pump gun of FIG. 2, the fore stock being in its forward end position, FIG. 5 is a perspective partial view of the pump gun of FIG. 4, FIG. 6 is a perspective partial view of a further embodiment mode of a pump gun, FIG. 7 is a perspective partial view of the pump gun of FIG. 6 where the fore stock is situated in a position between its forward and rear end positions, and FIG. 8 is a perspective partial view of the pump gun of FIG. 6 wherein the fore stock is in its forward end position.

Figure 1:
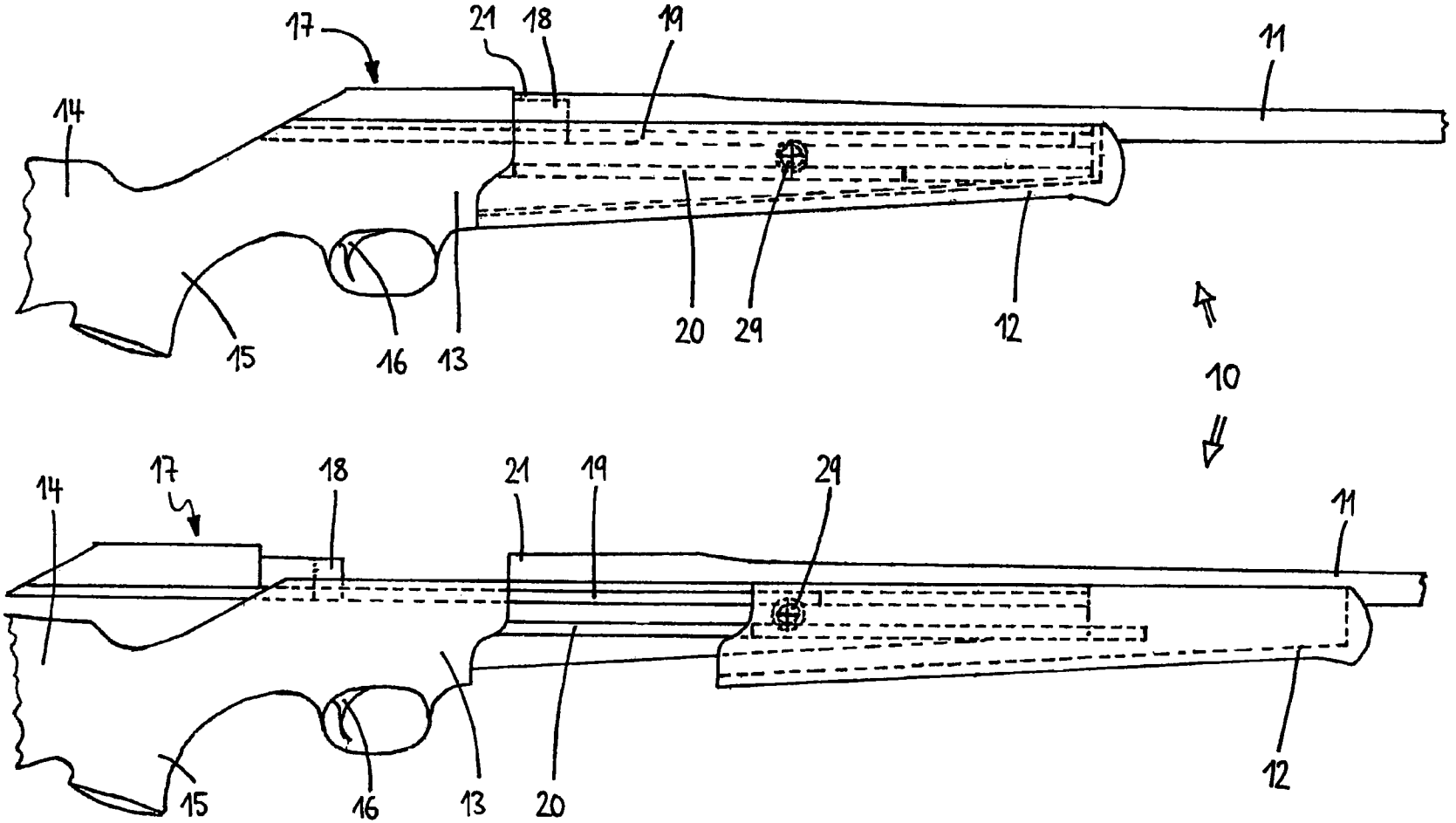
FIG. 1 shows two schematic sideviews of a pump gun.

The pump gun denoted in its entirety by 10 in FIG. 1 in both views comprises a barrel 11 and a main stock part 13 fitted at its rear with a gun butt 14 and merging at its front zone into a fore stock 12. A gun grip 15 is constituted between the stock 13 and the butt 14 and allows conveniently actuating a trigger 16. This trigger is configured directly in front of the gun grip 15 and below it into the main stock part 13. To implement firing, the trigger 16 is linked in (omitted) manner known per se to a cock which in turn drives a striking pin (also omitted). The main stock part 13 comprises a system chamber in the form of the barrel 11 running axially forward along the pump gun 10, its rear end 21 being closable by a breech lock 17. This breech lock is fitted with a breech lock head 18 which, when the weapon 10 is closed, can be made to engage the rear end 21 of the barrel 11.

To allow actuating the breech lock 17, the fore stock 12 is displaceable along the barrel 11. The upper half of FIG. 1 shows the pump gun 10 with the fore stock 12 in its rear end position and the breech lock 17 in its front closed position. The lower half of FIG. 1 shows the fore stock 12 in its front position and the breech lock 17 open to the rear.

The longitudinally displaceable fore stock 12 is linked by an actuation bar 19 configured parallel to the barrel 11 and by a push bar 20 running along the barrel 11 to the breech lock supported also in longitudinally displaceable manner. The push bar 20 is connected to the fore stock 12 whereas the actuation bar 19 is affixed to the breech lock 17. A rotatably supported gear 29 is configured between the two bars 19, 20 and engages toothed portions of the actuation bar 19 and of the push bar 20 that are not shown in further detail.

When manually displacing the fore stock 12 from the front end position (lower half of FIG. 1) into the rear end position (upper half of FIG. 1), the push bar 20 is moved by means of the fore stock 12 toward the rear end position. In the process, the gear 29 will rotate and the actuation bar 19 is moved from its rear into its front end position. Simultaneously the breech lock head 18 moves toward the barrel end 21; the breech lock 17 is being closed.

The displacement of the fore stock 12 from the front end position into the rear end position thereby entails an oppositely directed displacement of the breech lock 17 respectively the breech lock head 18. When the marksman pulls the fore stock 12 toward himself, the weapon 20 shall be both closed thereby and simultaneously pulled into his shoulder. To open the weapon 10, the fore stock 20 remaining ungripped is moved in simple manner from the rear into the front end position. The actuation bar 19 linked by the gear 29 to the push bar 20 directly displaces the breech lock 17 rearward. The breech lock head 18 moves rearward, the weapon 10 is opened and a fired cartridge is ejected.

The displacement reversal of the present invention allows making a pump gun 10 of which the fore stock 12 is situated in a rear d position when said gun is in the ready to fire initial state. In this initial position the pump gun 10 of the invention is devoid of the pumping excursion gaps of the state of the art. Accordingly degrading penetration of dirt is reliably precluded. Moreover the pump gun of the present invention does not require the stop of the state of the art because the fore stock 12 in its ready to shoot initial position already rests against the chamber 13. Instead the weapon 10 of the invention may be made unusually slender, this feature being especially esthetically pleasing for instance in hunting guns.

FIG. 2 is a perspective view of another embodiment mode of the invention of a pump gun 10, wherein the same elements are denoted by the same references as before. As regards case ejection and/or discharging an intact cartridge 31, a longitudinal recess 32 is provided on the side of the chamber 13. Said recess is used to eject an expended cartridge case and to reload with a new cartridge 31 from a magazine 30. Illustratively said magazine may be inserted from below into the chamber 13.

Figure 3:
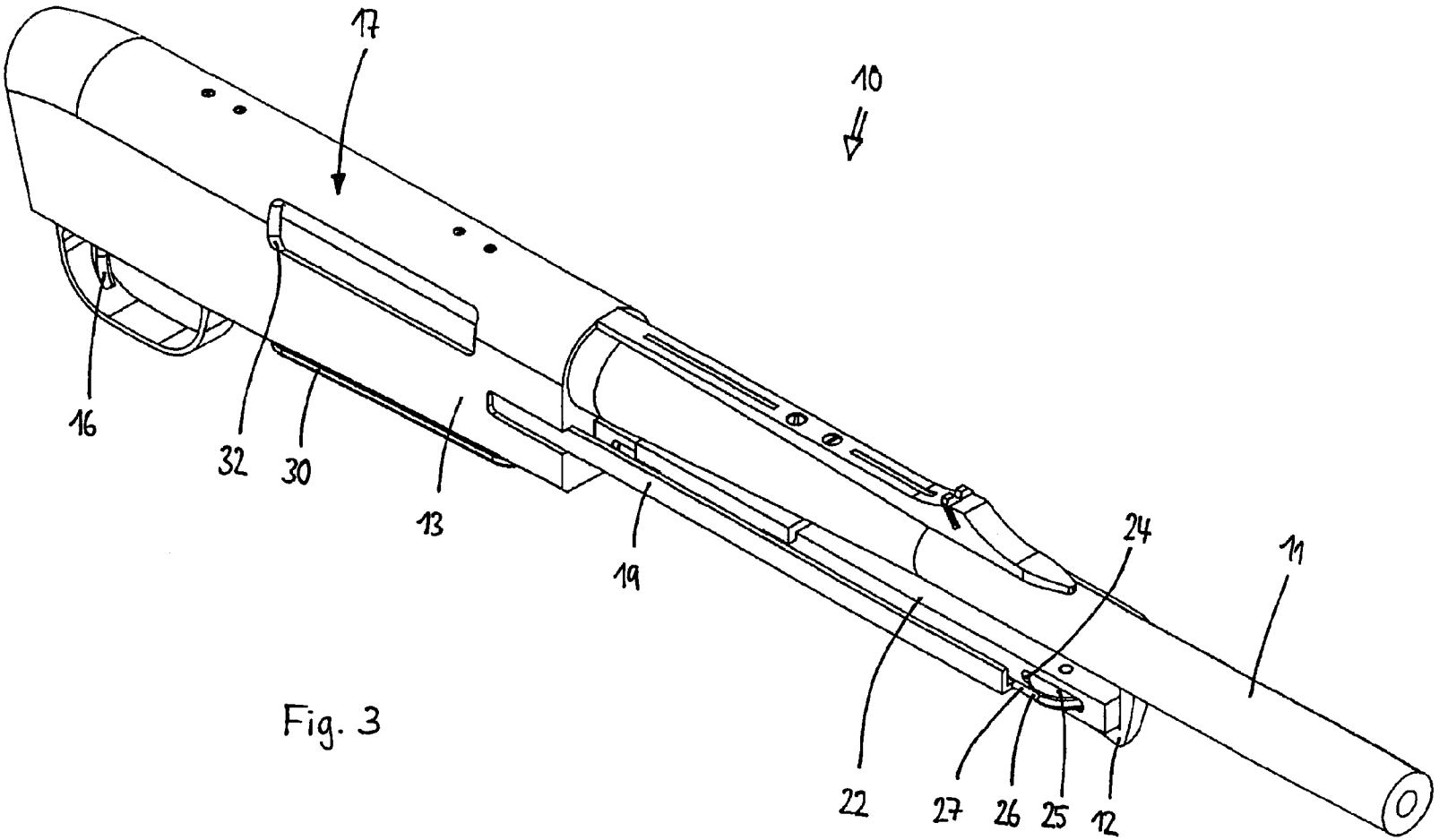
FIG. 3 is a perspective partial view of the pump gun of FIG. 2.

The partial view of FIG. 3 shows the inner design, usually masked, of the pump gun 10. The fore stock 12 of the pump gun 10 is shown in its rear end position, that is, in its ready to shoot position. A guide 22 is configured along the barrel 11 and receives a slide 23 which is displaceable in said guide. In passages 24 shown at the end zone of the guide 22, a disk 24 is rotatably supported (also see FIG. 5) in each case, the guide and the dish being looped by a belt 26, a chain or an endless belt. The fore stock 12 is affixed to the slide 23 which in turn is linked to one of the two segments (not visible in FIG. 3) of the looping drive constituted by the two disks 25 and the belt 26.

A manual displacement of the fore stock 12 is directly converted into a displacement of the slide 23 which in turn on account of its extant linkage to the segment 27 is converted into a rotation of the disks 25, in turn entailing a last, oppositely directed displacement of the actuation bar 19 (of the breech lock 17) connected to the looping drive. In summary, therefore, the breech lock 17 of the pump gun 10 may be opened by means of a displacement of the fore stock 12 into the front end position as indicated in FIGS. 4 and 5. FIG. 5 does show the fore stock 12 in the front end position with opened breech lock 17, and also the actuation bar 19 that, compared to the position indicated in FIG. 3, has been pushed into the chamber 13.

When a shot is fired, the sub-assembly of fore stock 12, push bar 20 and slide 23 is subjected to an inertial force causing it to lag behind the sub-assembly of barrel, chamber and breech lock moving rearward on account of recoil. The force peaks so generated may be countered by elastic components such as helical springs or damping elements configured in the paths of such forces.

FIGS. 4 and 5 also show that even though the fore stock 12 is situated in the front end position and the breech lock 17 is in the rear end position, the effective length over which the slide 23 is guided, and hence the fore stock 12, remains constant. Advantageously too the shown looping drive design is devoid of any direct contact with the barrel, this feature being mandatory for good firing views.

FIG. 6 shows a further embodiment mode of a pump gun 10 of the present invention, the fore stock 12 being in its rear end position. The actuation bar 19 (see also FIGS. 7 and 8) connected to the breach lock 17 and the push bar 20 connected by means of the slide 23 with the fore stock 12 is an economic ladder-type stamped mesh.

The manual displacement of the fore stock 12 and hence of the slide 23 ultimately displaces the push bar 20 of which the motion is converted by the gear 29 into an oppositely directed displacement of the actuation bar 19 of the breech lock 28 (FIGS. 7 and 8).

FIGS. 7 and 8 illustrate the mechanism of the present invention by means of the embodiment mode of FIG. 6 where a fore stock 12 is situated between the rear and front positions (FIG. 7) and a fore stock 12 being in the front position (FIG. 8). Accordingly the breech lock 17 is only partly open in FIG. 7 and fully open in FIG. 8.

The present invention is not restricted to only one of the above discussed embodiment modes, on the contrary it allows versatile and many modifications. Illustratively the gear (29) may be stepped (multi-layered), the gear steps having different numbers of teeth. If the actuation bar (19) engages the first gear step and the actuation bar (20) engages the second gear step, the reversal gear constitutes a step-down/step-up transmission and the two bars (19, 20) will travel different distances when the fore stock (12) is actuated. Obviously two gears (29) also may be used being configured parallel and next to each other, provided only that they be firmly affixed to each other.

The embodiment modes of the present invention shown in FIGS. 2 through 8 are appropriate to make so-called Bullpup weapons on account of the elimination of the cumbersome circumscription by the fore stock of the chamber bar in the vicinity of the shoulder. In Bullpup weapons the barrel is configured farther rearward toward the butt stock then in other known weapons and the magazine 30 is situated in the gun butt 14. As a result, this weapon is very short and compact.

Moreover a weapon may be kept short provided that the trigger 16 be configured not in the main stock part 13 but instead be integrated into the fore stock 12. As a result the trigger 16 will be part of the fore stock sub-assembly which shall be moved relative to the sub-assembly of barrel, chamber, breech lock and hence shall be moved forward in the direction of shooting to open the weapon. As a result, when the weapon is closed, it is possible to configure the magazine 30 directly above the trigger 16 or even underneath it, thus attaining an extremely advantageous configuration regarding weapon shortness. When the weapon has been opened, the magazine can be freely removed in the downward direction. Weapon handling is further improved in this manner.

The pump gun denoted overall by 10 in the upper and lower halves of FIG. 1 is fitted with a barrel 11 and a main stock part 13 comprising at its rear a gun butt 14 and merging at its front side into a fore stock 12. A gun grip 15 is constituted between the main stock part 13 and the gun butt 14 and allows conveniently actuating a trigger 16. Said trigger is integrated directly in front of the gun grip 15 and from underneath into the main stock part 13. To trigger the shot, it is linked in known manner to an omitted cock which in turn actuates a striking pin (also omitted). The main stock part 13. supports as system chamber the barrel 11 running forward in the axial direction of the pump gun 10 , said barrel's rear wend 21 being sealable by a breach lock 17. Said breech lock is fitted with breech lock head 18 which—in the closed position of the weapon 10—can be made to engage the rear end 21 of the barrel 11.

Lastly the embodiment modes shown in FIGS. 2 through 8 also may be reduced to practice on shotguns fitted with tubular magazines, the slides on the magazine tube being guided in irrotational but longitudinally displaceable manner and supporting the fore stocks 12. In this design the rotational elements of the looping drive, i.e. the gear 29 must be mounted rotationally and laterally on the magazine tube.

It is clear per se that the pump gun 10 of the present invention comprises a barrel 11, a main stock part 13, a fore stock 12 which is supported in longitudinally displaceable manner and a breech lock 17 connected to it, said breech lock being linkable to the rearward barrel end 21 when the pump gun 10 is in its closed state. The breech lock 17 and the fore stock 12 are connected in such manner that upon displacement of the fore stock 12, the breech lock 17 can be driven in the direction opposite that of the displacement of the fore stock 12. As a result the pump gun 10 can be safely handled even though being devoid of a stop and moreover it is also devoid of pumping excursion gaps in its ready to shoot initial state. Again, the weapon is ergonomically matched to the marksman and in its closed or ready to shoot state is esthetically pleasing.

All features and advantages explicit and implicit as disclosed in the claims, the description and the drawings, including design details, spatial configurations and procedural steps whether considered per se or in arbitrary combinations should be construed as being within the scope of the present invention.

LIST OF REFERENCE SYMBOLS

10 pump gun
11 barrel
12 fore stock
13 main stock part/chamber
14 gun butt
15 gun grip
16 Trigger
17 breech lock
18 breech lock head
19 actuation bar
20 push bar
21 barrel end
22 guide
23 slide
24 passage
25 disk
26 belt
27 segment (of belt, cable . . . )
28 lock
29 gear
30 (munitions) magazine
31 cartridge
32 longitudinal recess

The invention claimed is:

1. A pump gun (10) comprising a barrel (11), a main stock part (12), a fore stock (12) supported in longitudinally displaceable manner and linked to a breech lock (17) that, in the closed position of the said pump gun can be made to engage the rear barrel end (21) characterized in that the breech lock (17) and the fore stock (12) are linked to each other in a manner that when displacing the fore stock (12), the breech lock (17) can be driven in the direction opposite to that of the displacement of the fore stock (12).

2. The pump gun as claimed in claim 1, characterized in that the breech lock (17) and the fore stock (12) are linked to each other by means of a motion reversing transmission.

3. The pump gun as claimed in claim 2, characterized in that the motion reversing transmission consists of a push bar (20) linked to the fore stock (12), of an actuation bar (19) linked to the breech lock (17) and of at least one gear (29) which is supported in rotational manner and which engages portions of the push bar (20) and of the actuation bar (19) that are designed for such engagement.

4. The pump gun as claimed in claim 3, characterized in that that the portions of the push bar (20) and of the actuation bar (19) engaging the gear (29) are toothed or slotted.

5. The pump gun as claimed in claim 3, characterized in that the portions of the push bar (20) and of the actuation bar (19) designed to engage the gear (29) are fitted with recesses arrayed in ladder-like manner.

6. The pump gun as claimed in claim 5, characterized in that said recesses pass through the material in which they are made.

7. The pump gun as claimed in claim 3, characterized in that the gear (29) is supported on a pivot affixed to the chamber.

8. The pump gun as claimed in claim 2, characterized in that the gear (29) is rotatably mounted on a guide (22) running along the barrel (11).

9. The pump gun as claimed in claim 8, characterized in that a slide (23) is displaceably mounted on the guide (22) and that the fore stock (12) and the push bar (20) are affixed to said slide.

10. The pump gun as claimed in claim 1, characterized in that the breech lock (17) and the fore stock (12) are linked by means of a looping drive, a belt drive, a belt transmission or the like.

11. The pump gun as claimed in claim 10, characterized in that the looping drive is constituted by two disks (25) and one belt (26) looping the set of said two disks.

12. The pump gun as claimed in claim 10, characterized in that the looping drive is constituted by two rollers and one endless rope or cable looping the set of two rollers.

13. The pump gun as claimed in claim 10, characterized in that the looping drive is constituted by two sprockets and one chain looping the set of two sprockets.

14. The pump gun as claimed in claim 10, characterized in that the looping drive is constituted by toothed disks and one toothed belt looping the set of said two disks.

15. The pump gun as claimed in claim 10, characterized in that the rollers, the sprockets, the disks (25) or the toothed disks are rotatably supported on a guide (22) configured along the barrel, a slider (23) being displaceably mounted on said guide and the fore stock (12) being affixed to said slider, the slider (23) being connected to one of the segments (27) of the looping drive and an actuation bar (19) connected to the breech lock (17) being linked to the other of the two segments (27).

16. The pump gun as claimed in claim 1, characterized in that the reversal transmission, the looping drive, the belt drive, the belt transmission or the like is a stepdown or a stepup transmission.

* * * * *